US006481233B1

(12) United States Patent
Calvert

(10) Patent No.: US 6,481,233 B1
(45) Date of Patent: Nov. 19, 2002

(54) HIGH-PERFORMANCE MOLDED FAN

(75) Inventor: Phillip D. Calvert, Center, TX (US)

(73) Assignee: General Shelters of Texas, S.B., Ltd., Center, TX (US)

( * ) Notice: Subject to any disclaimer, the term of this patent is extended or adjusted under 35 U.S.C. 154(b) by 0 days.

(21) Appl. No.: 10/096,620

(22) Filed: Mar. 12, 2002

Related U.S. Application Data

(63) Continuation of application No. 09/796,420, filed on Feb. 28, 2001, now Pat. No. 6,378,322.

(51) Int. Cl.[7] ..... F28D 5/00
(52) U.S. Cl. ..... 62/314; 415/222; 416/205
(58) Field of Search ..... 62/314; 415/211.1, 415/222, 223; 416/61, 205, 207, 209

(56) References Cited

U.S. PATENT DOCUMENTS

| | | | | | |
|---|---|---|---|---|---|
| 397,194 | A | * | 2/1889 | Hebert | 340/294 |
| 4,132,499 | A | | 1/1979 | Igra | 415/220 |
| 4,720,244 | A | | 1/1988 | Kluppel et al. | 416/224 |
| 4,895,489 | A | | 1/1990 | Kohama et al. | 415/220 |
| D306,903 | S | | 3/1990 | Shin-Chin | D23/382 |
| 4,927,324 | A | | 5/1990 | Coup et al. | 415/121.2 |
| 5,096,373 | A | | 3/1992 | Struve et al. | 415/60 |
| RE34,551 | E | | 2/1994 | Coup et al. | 415/121.2 |
| 5,348,447 | A | | 9/1994 | Redetzke | 416/247 R |
| 5,423,660 | A | | 6/1995 | Sortor | 416/189 |
| D362,904 | S | | 10/1995 | Wulf et al. | D23/351 |
| D362,905 | S | | 10/1995 | Wulf et al. | D23/351 |
| 5,480,282 | A | | 1/1996 | Matson | 415/125 |
| 5,606,868 | A | | 3/1997 | Calvert | 62/315 |
| 5,611,665 | A | | 3/1997 | Angel | 416/205 |
| 5,611,668 | A | | 3/1997 | Yapp | 416/189 |
| 5,655,882 | A | * | 8/1997 | Morgan et al. | 416/204 R |
| 5,676,979 | A | | 10/1997 | Folsom et al. | 425/13 |
| 5,691,391 | A | | 11/1997 | Chen et al. | 521/99 |
| 5,741,450 | A | | 4/1998 | Monroe et al. | 264/102 |
| D397,194 | S | | 8/1998 | Hebert | D23/354 |
| 5,863,182 | A | | 1/1999 | Hill | 416/237 |
| 5,922,095 | A | | 7/1999 | Hustvedt et al. | 415/220 |
| 6,045,327 | A | | 4/2000 | Amr | 415/220 |
| 6,116,856 | A | | 9/2000 | Karadgy et al. | 416/209 |
| 6,182,463 | B1 | * | 2/2001 | Strussion et al. | 62/304 |
| 6,212,897 | B1 | * | 4/2001 | Wang | 261/78.1 |
| 6,283,705 | B1 | | 9/2001 | Rice et al. | 415/220 |

* cited by examiner

*Primary Examiner*—William E. Tapolcai
*Assistant Examiner*—Mohammad M. Ali
(74) *Attorney, Agent, or Firm*—Locke Liddell & Sapp LLP

(57) ABSTRACT

In one embodiment, the present invention provides a high performance molded, substantially non-metallic fan capable of producing at least about 20 cubic feet per minute ("CFM") per input watt at a static pressure of about 0.00 inches of water. In one embodiment, the fan combines a substantially non-metallic housing, an airfoil cross-sectional fan blade, and a non-metallic hub. The fan blades may be detachable from the hub and rotationally indexable to a variety of pitch angles. Further, the hub and fan blades may include alignment indicia, so that the fan blades can be adjusted to a commensurate pitch relative of other fan blades around the hub.

18 Claims, 8 Drawing Sheets

HIGH-PERFORMANCE MOLDED FAN

CROSS REFERENCES TO RELATED APPLICATIONS

This application is a continuation application of now U.S. patent application Ser. No. 09/796,420 filed on Feb. 28, 2001 now U.S. Pat. No. 6,378,322 filed Apr. 30, 2002.

FIELD OF THE INVENTION

The present invention applies to fans and portions thereof. More particularly, the present invention applies to fans at least partially constructed of molded products.

BACKGROUND OF THE INVENTION

Fans, in one form or another, have been used for thousands of years. A large leap in fan design occurred with the advent of electricity in the early part of the twentieth century. Since that time, fans have continued to evolve, albeit in relatively small and incremental steps. The typical fan, such as an electric fan, includes a motor and a hub about which a plurality of fan blades rotate. The motor can be directly attached to the hub, such as by placing the hub concentrically around the shaft of the motor, and is known as a "direct drive" fan. Alternatively, the hub can be mounted separately from the motor on a pulley with a corresponding pulley mounted to the motor. A drive belt generally is coupled to the pulleys and transfers rotational torque from the motor to the pulley on the hub, and is known as a "belt driven" fan, which can include a drive belt, chain, gear, and other load transfer elements. In either type, the motor rotates the hub with the fan blades and causes air to be displaced or deflected in a direction away from the blade to create air flow.

Also, since the early part of the twentieth century, fans have been made from metal and wooden components. Typically, a belt driven metallic fan includes two piece hubs where the blades are attached to one piece and a pulley is formed on or attached to a second piece. The first and second pieces of the hub are bolted, welded, or otherwise connected together. In some metallic fans, the blades are stamped from sheets of material and generally have a uniform thickness through a cross-section of the blade. These types of fan blades are termed a "deflector" type of blade. The fan blade can be welded to the hub, or otherwise attached with rivets, clamps, or screws. In smaller fans, the hub and blades were made as a single piece. However, the stamping process is limited in the depth, length, and angle of the blades, and other practical limitations due to the process. The rotating metal parts of the fan, such as the hub and fan blades, are typically balanced, machined, or otherwise finely tuned to produce high performance fans. High performance fans can produce a relatively large cubic feet per minute (CFM) flow per energy input, such as an electrical watt. Thus, the efficiency can be relatively high on metal fans. However, a high-performance metal fan is generally costly to produce with such efficiency and not suited to general commercial use.

Further developments were made in the evolution of fans with the advent of structural plastics. However, the plastic fans and components, such as hubs and blades, have been relegated to low performance, commercial uses due to design, material, and manufacturing process limitations. The tolerances, molding techniques, and structure generally resulted in a low-cost, low-performance plastic fan. A low-cost, high performance plastic fan eluded those with ordinary skill in the art.

Therefore, there remains a need for a molded plastic fan at relatively low-cost with high-performance capability.

SUMMARY OF THE INVENTION

In one embodiment, the present invention provides a high performance molded, substantially non-metallic fan capable of producing at least about 20 cubic feet per minute ("CFM") per input watt at a static pressure of about 0.00 inches of water. In one embodiment, the fan combines a substantially non-metallic housing, an airfoil cross-sectional fan blade, and a non-metallic hub. The fan blades may be detachable from the hub and rotationally indexable to a variety of pitch angles. Further, the hub and fan blades may include alignment indicia, so that the fan blades can be adjusted to a commensurate pitch relative of other fan blades around the hub.

In another embodiment, the invention provides for a cooler such as an evaporative cooler, comprising a molded cooler housing supported on a base, having an exterior, an interior, and front and rear openings, the base being integrally formed with the housing, at least one brace integrally formed with the housing and capable of supporting at least one evaporative cooling pad positioned within the rear opening of the housing, a molded fan brace coupled to the cooler housing, a molded hub coupled to the fan brace and having a plurality of fan blade receivers, and a plurality of molded fan blades removably attachable to the fan blade receivers, the fan blades each having a blade portion attachable to the fan blade receivers.

In another embodiment, a cooler is provided, comprising a molded cooler housing supported on a base, having an exterior, an interior, and front and rear openings, the base being integrally formed with the housing, at least one brace integrally formed with the housing and capable of supporting at least one evaporative cooling pad positioned within the rear opening of the housing, a molded fan brace coupled to the cooler housing, a molded hub coupled to the fan brace and having a plurality of fan blade receivers, a plurality of molded fan blades removably attachable to the fan blade receivers, the fan blades each having a blade portion attachable to the fan blade receivers on the hub and formed with an airfoil cross section and a longitudinal twist from the blade portion toward a tip end of the fan blades, a first alignment indicia disposed on the fan blade receivers and a second alignment indicia disposed on the fan blades, the cooler having an efficiency rating of at least about 20 CFM of airflow per watt at a static pressure of about 0.00 inches of water.

Further, a molded fan is provided, comprising a molded hub having a plurality of fan blade receivers, and a plurality of molded fan blades coupled to the hub, the fan blades comprising an airfoil cross section having a high pressure portion on one side and a low pressure portion of an opposite side. A fan is also provided, comprising a molded hub having a plurality of fan blade receivers, a plurality of molded fan blades coupled to the fan blade receivers, and a venturi wherein the fan blades are adapted to at least partially rotate within a cross sectional volume formed by the venturi, the fan producing an air flow of at least about 20 CFM of airflow per watt at a static pressure of about 0.00 inches of water.

BRIEF DESCRIPTION OF DRAWINGS

A more particular description of the invention, briefly summarized above, may be had by reference to the embodiments thereof which are illustrated in the appended drawings and described herein. It is to be noted, however, that the appended drawings illustrate only some embodiments of the invention and are therefore not to be considered limiting of its scope for the invention may admit to other equally effective embodiments.

DETAILED DESCRIPTION OF THE INVENTION

Figure 1:
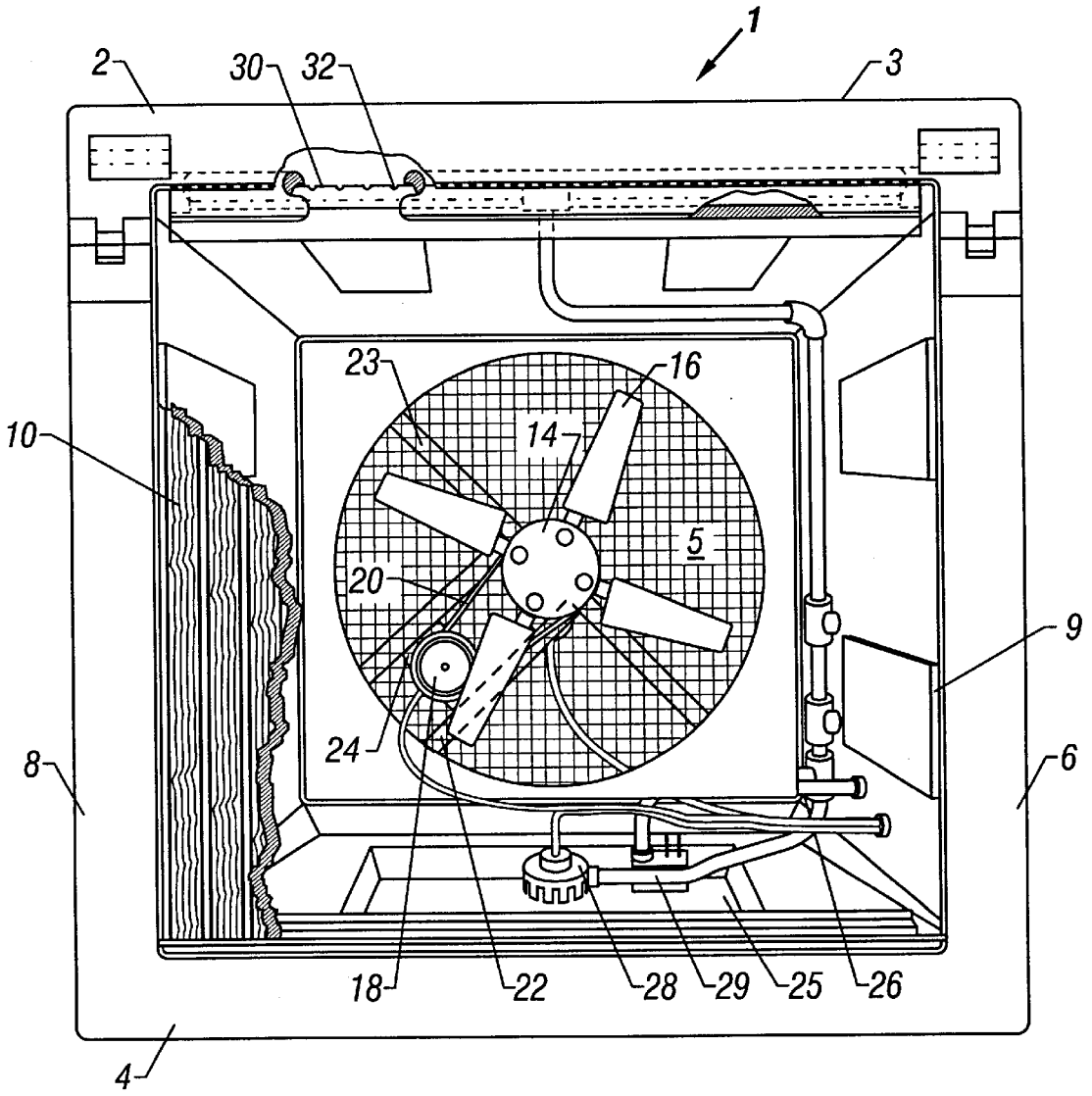
FIG. 1 is a schematic perspective rear view of one embodiment of a fan in the form of an evaporative cooler.

FIG. 1 is a schematic perspective rear view of one embodiment of a fan 1. Although many types of fans can include the features discussed herein, one embodiment of the fan 1 is an evaporative cooler. As an example, one cooler is described in U.S. patent application Ser. No. 09/273,096, filed Mar. 19, 1999, entitled "Cooler Housing Apparatus and Method of Making the Same" and is incorporated herein by reference.

The fan 1 generally includes a housing having a top 3, a bottom 4, and sides 6, 8. The housing 2 forms a structure in which various components may be mounted thereto. A portion of the fan 1 includes an air moving system that generally includes a hub 14 and a plurality of fan blades 16 attached thereto. A motor 18 can be used to drive the fan. Fans typically move ambient air and thus the term "air" is used as a convention. However, the term "air" used herein includes any media through which the fan blades move. The hub and blades rotate within an opening 5 formed in the housing 2. If the fan is a belt-driven fan, the motor 18 is offset from a central axis of the hub. A drive member 20 can be coupled between the motor 18 and the hub 14. The drive member can include, for example, a drive belt, chain, gear, and other elements. The drive member 20 assists in transmitting torque from the motor 18 to the hub 14 to rotate the hub and the fan blades 16 attached thereto.

The housing 2 may be formed out of a variety of materials. In at least one embodiment, the housing is formed of a moldable material, such as polymeric compounds with or without fiber reinforcing materials and generally includes plastic materials.

A brace 23 may traverse at least a portion of the housing 2 to provide additional support for mounting the hub 14 and associated elements. Additional bracing, such as brace 22, can be coupled to the brace 23. The brace 22 can include a motor support 24. The motor support 24 supports the motor 18 in a proper orientation with the hub 14 and generally includes one or more holes for attaching the motor 18 thereto.

The housing 2 may include one or more supports 9 that are used to support an evaporative cooling pad 10. The evaporative cooling pad 10 provides a media through which cooling material, such as water, may be disposed thereon. Air is driven through the evaporative cooling pad 10 as the hub and fan blades rotate, so that the air lowers the effective temperature of ambient air by providing moisture thereto.

The bottom 4 of the housing 2 can include a recessed area 25. The recessed area 25 may form a canopy for holding water or other liquids that can be used in conjunction with the fan 1. An inlet 26 is fluidicly coupled to the recessed area 25 for providing fluid thereto. A pump 28 is fluidicly coupled to a fluid contained in the recessed area 25. The pump 28 provides pressurized fluid into an outlet 29. The outlet 29 is coupled to a sprayer 30, generally disposed in an upper portion of the fan 1. The sprayer 30 can include one or more ports 32 through which the fluid may be provided, for example, to the evaporative cooling pad 10. The cooling pad 10 allows the fluid to flow generally by gravity across surfaces of the pad as the air passes across the pad to effect the cooling described above.

Further, the housing 2 may include attachment sites (not shown) used for wheels or casters, provide other locations for fluid storage, and may include various aesthetic and ornamental aspects that distinguish the housing from predecessors in the prior art and allow the formation of product identity. The housing may include, for example, recesses that may strengthen the housing and offer a location for placement and protection of plumbing assemblies and connections thereto.

Figure 2:
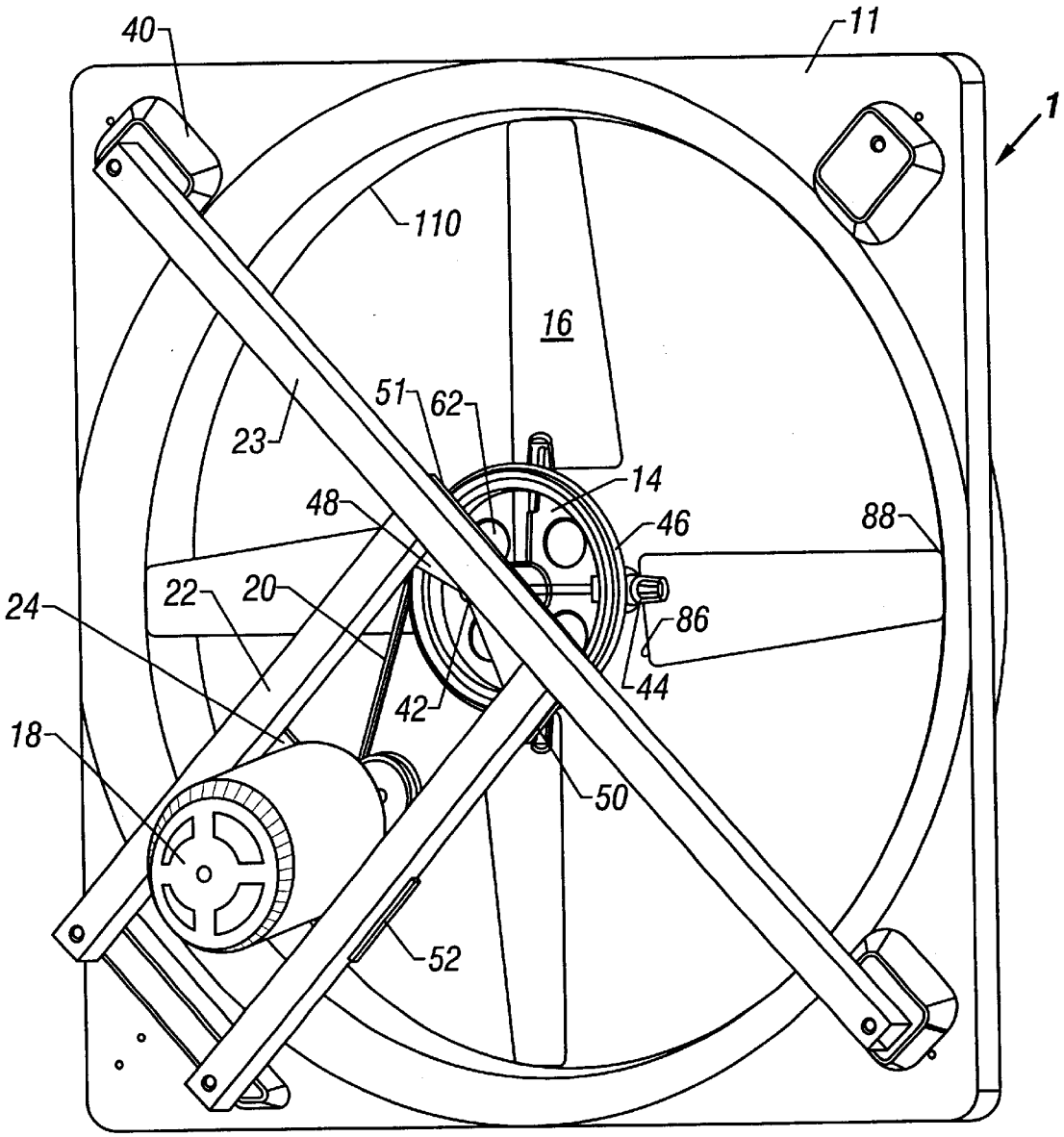
FIG. 2 is a schematic perspective rear view of the fan shown in FIG. 1.

FIG. 2 is a schematic perspective rear view of the fan shown in FIG. 1. A frame member 11 of the fan 1 can be coupled to the housing 2 or can be formed integrally therewith. The frame member 11 can include one or more shelves 40. The shelves 40 provide an elevated surface to which the braces 22, 23 may be coupled thereto. The braces may be coupled by fasteners, adhesives, or other generally known attachment devices and methods.

In one embodiment, the brace 22 intersects the brace 23 in the area of the hub 14. Further, the brace 22 can be coupled to the motor support 24. The hub 14 can be rotationally coupled to the brace 23 by a shaft 42. The shaft 42 can 10 be connected to the brace 23 and extend through the brace 23 into a central opening (not shown) of the hub 14. The hub 14 can rotate about the shaft 42.

A drive member 20 is generally disposed between the hub 14 and the motor 18. The drive member 20 is coupled to the hub about a drive surface 46. The drive surface can support a drive belt, gear, chain or other drive member. If a belt is used, typically the belt is a "V-drive" shaped belt, although other shapes of belts can be used. Alternatively, the motor can be directly coupled to the hub 14 as described in reference to FIG. 16 herein.

The hub 14 can include one or more holes 62 that can be used to decrease the mass of the hub 14. A lower mass may assist in reducing balancing requirements of the assembly. For example, in one embodiment, the combined weight of the hub and four fan blades for a 36-inch fan is approximately 5 lbs. or less and can be about 4 lbs. The mass of this assembly can be relatively low compared to prior art assemblies of about 10 pounds and still provide high performance.

A brace support 48 can be used to provide additional support at the intersection of braces 22, 23. Further, the brace support 48 may include at least one stiffener 50 disposed to the sides of the brace 22 and a stiffener 51 disposed to the side of brace 23. The one or more stiffeners 50, 51 provide additional strength to the coupling of the braces 22, 23.

In one embodiment, the braces 22, 23 may be formed of molded non-metallic material. For example, a process known as "pultrusion" may form the molded material. In pultrusion, moldable composite material is drawn across a heated mandrel and formed into some shape, such as a tubular member.

The brace support 48 may be coupled to the braces 22, 23 by various methods of attachment such as mechanical fasteners using bolts, pins, screws, or other mechanical devices, or may be attached by adhesive methods, welding, or other attachment methods. Similarly, the motor support 24 may be coupled to the brace 22 in like fashion. The motor support 24 may also include a stiffener 52 disposed on one or both sides of the brace 22 for increased support. In one embodiment, the housing, blades, hub, braces, and supports may be made from molded and corrosion resistant materials. Such materials are described in more detail below and generally include polymeric and other plastic materials.

The blades 16 are coupled to the hub 14 with a blade portion 44. The blade portion 44 is generally located at a "root" of the blade, also referred to as a "root end" 86 that is closer to the hub than an outer end, referred to as a "tip end" 88. The blade portion 44 can be removably coupled to the hub 14. Further, the blades can be rotated with respect to the hub to different pitch angles, described in more detail in reference to FIG. 15.

A venturi 110 can be coupled with the frame member 11. The venturi 110 can be integrally formed with the frame member 11 or the housing 2 or formed separately and attached thereto. The venturi 110 forms a volumetric space across its diameter and along its depth through which the plurality of blades 16 may rotate. The venturi 110 increases the air efficiency and may help reduce turbulence. Such reduction of turbulence increases a laminar flow of air through the fan 1 or other types of fans for greater efficiency of air flow and fan performance. The venturi is described in more detail in reference to FIGS. 17–18.

Figure 3:
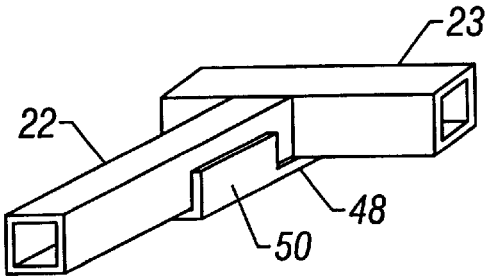
FIG. 3 is a schematic perspective view of a brace of the fan.
Figure 4:
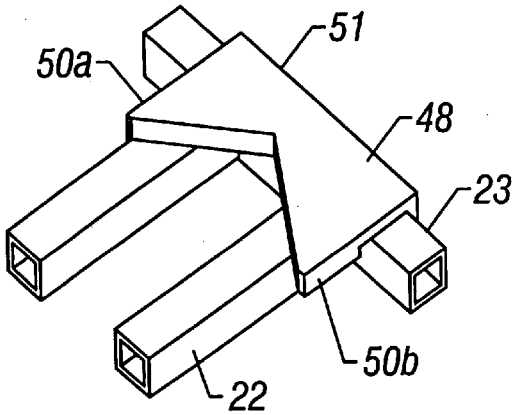
FIG. 4 is a schematic perspective rear view of the brace, shown on FIG. 3.

FIG. 3 is a schematic perspective view of a brace of the fan. FIG. 4 is a schematic perspective rear view of the brace, shown in FIG. 3. FIGS. 3 and 4 include similar elements and will be described in conjunction with each other. The brace support 48 includes one or more stiffeners 50, 51. The stiffeners 50, 51 provide lateral support of the braces 22, 23 and/or other members. As shown in FIG. 4, the brace support 48 can include three support areas. A stiffener 50*a* is disposed on one side of the brace 22, a stiffener 50*b* is disposed on a second side of brace 22, and a stiffener 51 is disposed on the side of brace 23. Thus, three support points can substantially encapsulate the intersection of the braces 22, 23, so that the connection between the braces can be strengthened. In some embodiments, alternative bracing may be used and in other embodiments, stiffeners and/or bracing may not be used at all.

Figure 5:
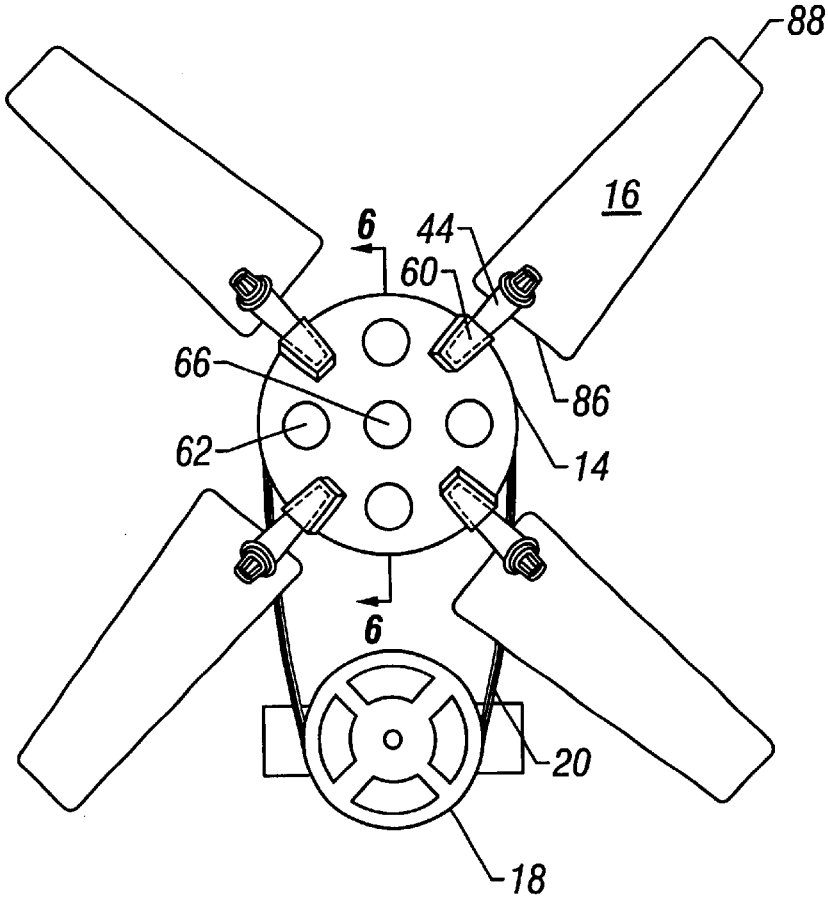
FIG. 5 is a schematic front view of a fan having a hub and a plurality of fan blades.

FIG. 5 is a schematic front view of a fan having a hub and a plurality of fan blades. The fan blades include one or more blade portions 44 that can used to couple the fan blades 16 to the hub 14. In one embodiment, the blade portion 44 is removably coupled to a blade receiver 60 on the hub 14 and is described in more detail in reference to FIG. 7.

Further, the hub 14 may include one or more holes 62 disposed therein. The holes 62 generally are located at lower stress areas, such as between a central opening 66 in the hub about which the hub rotates and an outer periphery of the hub where the blade receivers 60 are formed. The holes 62 can be used to lessen the mass of the hub and in general the rotating structure. A lower mass is generally easier to balance and can allow higher RPMs for higher performance.

Figure 6:
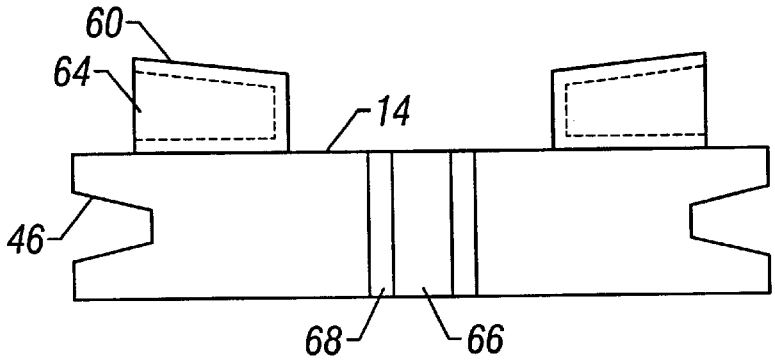
FIG. 6 is a schematic cross sectional view of a belt drive hub.

FIG. 6 is a schematic cross sectional view of a belt drive hub. For efficiency, it may be desirable to form the hub 14, drive surface 46, and a plurality of blade receivers 60 as an integral unit. Alternatively, the hub 14 can be formed of one or more pieces and the pieces coupled together. For example, the blade receivers 60 could be formed separate from the hub 14 and coupled thereto in a subsequent operation.

In some embodiments, such as a direct drive fan system, the drive surface 46 may not be formed on the hub and would be an extraneous feature in driving the fan. For example, the fan may be directly attached to the hub such that no intermediate drive element, such as a drive belt, may be used.

The hub 14 can include one or more blade receivers 60 formed thereon. Each of the blade receivers 60 generally includes a blade aperture 64 that is adapted to receive the blade portion 44 at the root end of the blade 16 so that the blade 16 can be coupled to the hub 14. Generally, an opening 66 can be formed in the hub 14 for receiving a shaft (not shown) therein. A bearing 68 may be included in the opening 66 and generally reduces friction between the shaft and the hub 14. For example, the bearing can be a roller, ball, or sleeve type of bearing. A one-piece hub having the integral drive surface and blade receivers may be used to advantage in production efficiency. However, the invention is not limited to a one-piece assembly.

Figure 7:
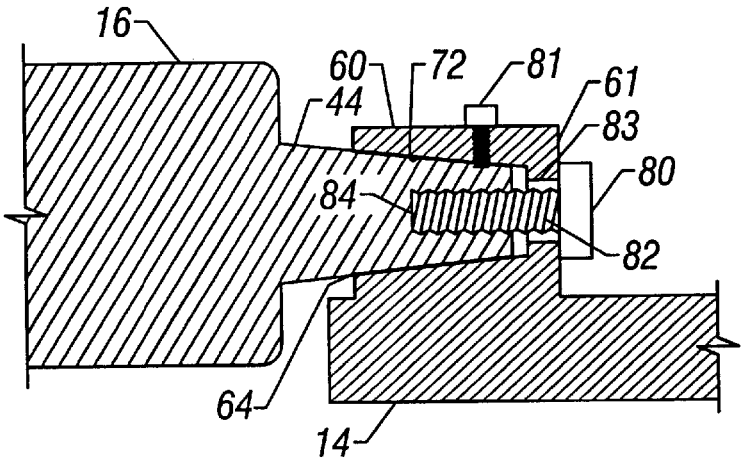
FIG. 7 is a schematic cross sectional view of a fan blade receiver and a blade portion coupled thereto.

FIG. 7 is a schematic cross sectional view of a fan blade coupled to a hub. A blade portion 44 on the fan blade 16 and a blade receiver 60 on the hub 14 can be used to couple the blade and the hub together. The blade receiver 60, in one embodiment, can include a receiving taper 72. In one embodiment, the blade receiver 60 may also include an end wall 61 distal from the point of entry of the blade in the blade receiver and an aperture 83 formed in the end wall. For example and without limitation, the taper 72 can be about 1° to about 5°, although other angles are possible. In like manner, the blade portion 44 can include a corresponding taper for insertion into the receiving taper 72 of the blade receiver 60.

The attachment of the blade 16 to the hub 14 may be further enhanced by use of a retainer 80, such as a bolt or screw. The retainer 80 can be inserted through the aperture 83 in the end wall 61 of the blade receiver 60 and pull the blade 16 toward the end wall into a secure position in the blade receiver. The retainer 80 can include threads 82 for coupling to the blade 16. The blade 16 can similarly include receiving threads 84. Another retainer 81 can be used to secure the fan blade 16 in position and can be inserted transverse to the blade portion 44 after the blade is positioned in the blade receiver 60.

In operation, the blade 16 is coupled to the hub 14 by inserting the blade portion 44 into the receiving taper 72. The blade can be aligned into a particular pitch angle by rotating the blade about its longitudinal axis. The retainer 80 is disposed through the aperture 83 in the end wall 61 of the blade receiver 60. The retainer 80 is threaded into the receiving threads 84 of the blade 16. As the retainer 80 is rotated, the blade portion 44 is drawn tight into the receiving taper 72 until a suitable fit is obtained. Other fastening systems can be used and the example provided in FIG. 7 is merely for illustrative purposes of securing a fan blade to a hub.

Figure 8:
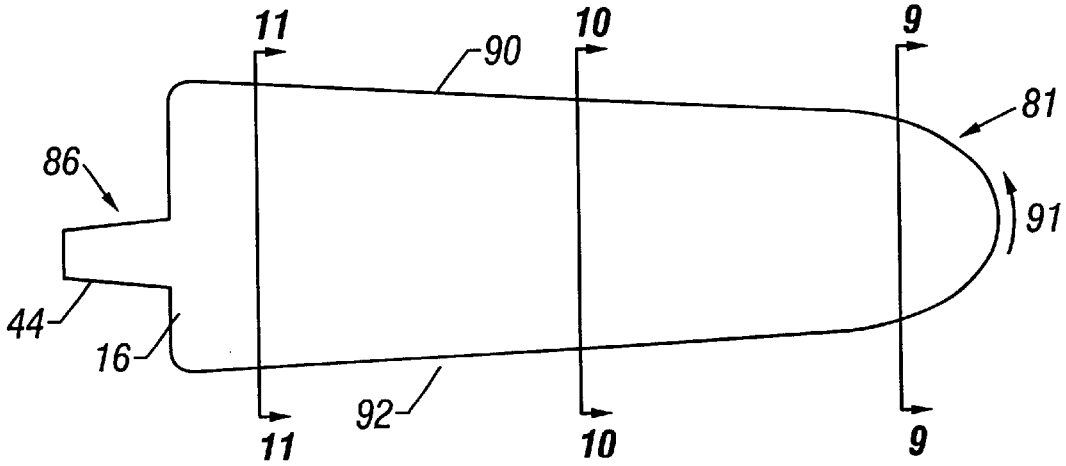
FIG. 8 is a schematic front view of an airfoil fan blade.

FIG. 8 is a schematic front view of a fan blade. The blade 16 has a root end 86 and a tip end 88. The root end 86 generally includes a blade portion 44 that can be coupled to the hub (not shown). The tip end 88 is disposed away from the hub and has the highest circumferential speed of the blade 16 when the blade is rotated. As the blade 16 travels in the direction of rotation 91, a front edge, known as a leading edge 90, first engages air or other media through which the blade travels. A last edge of the blade to engage the air, otherwise known as a trailing edge 92, is generally disposed opposite the leading edge 90. In one embodiment, the leading edge is relatively parallel to a centerline 128 that passes through the blade portion 44. However, the trailing edge 92 can be nonparallel to the centerline 128, so that the blade narrows in width toward the tip end 88. Other shapes and formations can be made and the blade described herein in merely exemplary.

Figure 9:
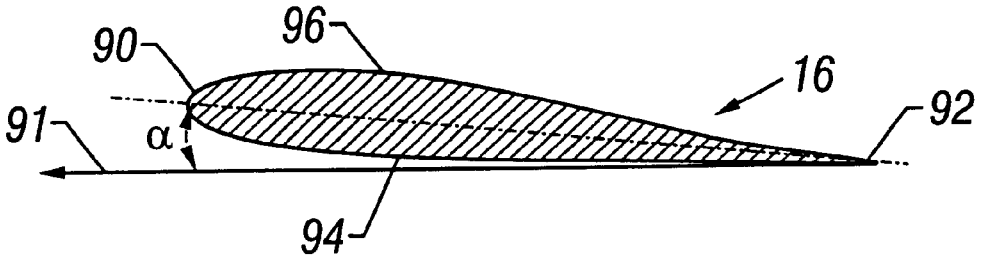
FIG. 9 is a schematic cross sectional view of the fan blade shown in FIG. 8 at Section 9 detailing the airfoil design.

In one embodiment, the cross sectional shape of the blade 16 can include an airfoil design. The term "airfoil" design, as used herein, includes a fan blade with a cross section that has a length on one surface of a fan blade that is different than the length on a corresponding opposed surface of the fan blade, as illustrated in FIG. 9 below. As is known to those with skill in the art of manufacturing airplane wings, a top surface of the airplane wing generally has a longer length compared to a shorter length on the lower surface of the blade. Air travels over the two surfaces and a low pressure region is created on the longer surface on the top of the blade compared to a high pressure region that is created on the lower surface. The difference in pressures creates a lift for the airplane to fly.

Figure 10:
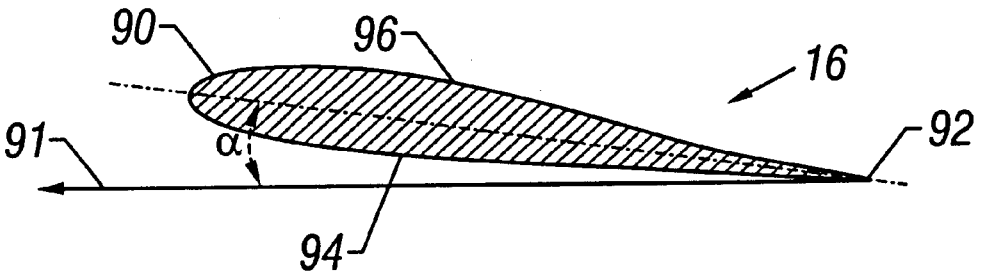
FIG. 10 is a schematic cross sectional view of the fan blade shown in FIG. 8 at Section 10.
Figure 11:
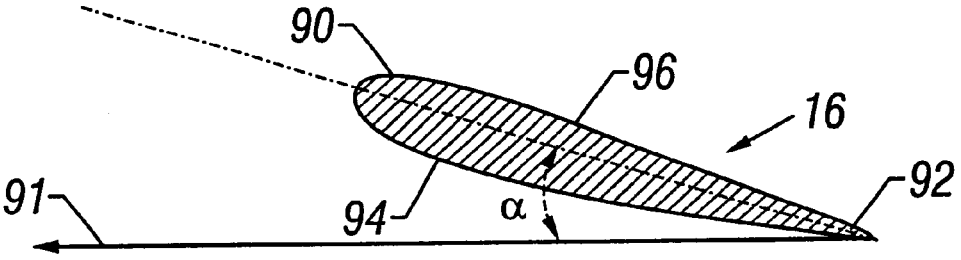
FIG. 11 is a schematic cross sectional view of the fan blade shown in FIG. 8 at Section 11.

It is believed that such an airfoil design has not been applied to a fan blade and especially a molded fan blade. The inventor recognized that increased efficiency and high performance could be gained by designing an airfoil cross section into the fan blade 16. Further, the blade 16 may twist along its longitudinal axis from the root end 86 to the tip end 88 or portion thereof. Such a twist can decrease an angle of attack, otherwise known as a pitch angle, of the leading edge 90 toward the tip end 88. FIGS. 9–11 show examples of a twist.

The tip end 88 is disposed outwardly from the rotational center of the hub (not shown). Thus, the speed or rotational velocity of the tip end 88 is greater than portions of the blade disposed closer to the rotational center. In one embodiment, the pitch angle of the tip end 88 is smaller than the pitch angle of the blade at the root end 86. The differences in pitch angles can be used to more evenly distribute a load created on the blade during rotation to account for different rotational velocities of portions of the blade 16. The pitch angle is described in more detail in reference to FIGS. 9–11 below.

FIG. 9 is a schematic cross sectional view of the fan blade shown in FIG. 8 at Section 9 toward the tip end 88. The blade 16 includes a high pressure surface 94 and a low pressure surface 96 disposed on another side of the blade 16 from the high pressure surface. Generally, the blade 16 increases in cross sectional thickness from the leading edge 90 and then tapers down to a smaller thickness at the trailing edge 92.

In one embodiment, the blade includes an "airfoil" shape, as the term is used herein, in that a length 97 along the low pressure surface 96 of the blade measured from the leading edge 90 to the trailing edge 92 is longer than a corresponding length 99 along the high pressure surface 94 of the fan blade. An angle of attack, or pitch angle $\alpha$, is measured from a line representing the direction of rotation 91 to a line 93 representing a chord between the leading edge 90 and the trailing edge 92. The pitch angle $\alpha$ could be small and in some embodiments may be negative, i.e., below the direction of rotation 91, as shown in FIG. 9. A lower pitch angle toward the tip end 88, shown in FIG. 8, assists in minimizing loads on the blade. For example, the pitch angle $\alpha$ can be adjusted so that a fraction of the available surface area of the low pressure surface 96 is higher than the trailing edge 92 surface, so that less air is moved than could be moved at higher pitch angles. Lessening the width of the blade toward the tip end 88 can further reduce the surface area. Less width creates less surface area and less pressure to move air.

FIG. 10 is a schematic cross sectional view of the fan blade shown in FIG. 8 at Section 10 at a portion nearer the root end 86 than Section 9. The blade is formed with a "twist," so that the leading edge 90 is disposed at a greater relative height than the trailing edge 92 in FIG. 10 compared to the relative height shown in FIG. 9. Thus, the orientation results in an increased pitch angle $\alpha$ measured between the line representing the direction of rotation 91 and a line 93 representing a chord between the leading edge 90 and the trailing edge 92. The increased pitch angle $\alpha$ results in a greater force on the blade and also produces an additional flow of air from the blade. The greater force on the blade 16 at Section 10 is applied at a cross section that is disposed nearer to the point of attachment of the blade to the hub (not shown). Structural stresses are reduced on the blade 16 by concentrating the forces nearer to the hub.

FIG. 11 is a schematic cross sectional view of the fan blade shown in FIG. 8 at Section 11 that is nearer to the root end 86 than Section 10 shown in FIG. 10. The blade 16 is oriented at a greater pitch angle $\alpha$. The increased pitch angle $\alpha$ results in an additional flow of air and an increased force on the blade 16. The additional forces are advantageously applied nearer to the root end 86 and the connection between the fan blade 16 and the hub (not shown).

Figure 12:
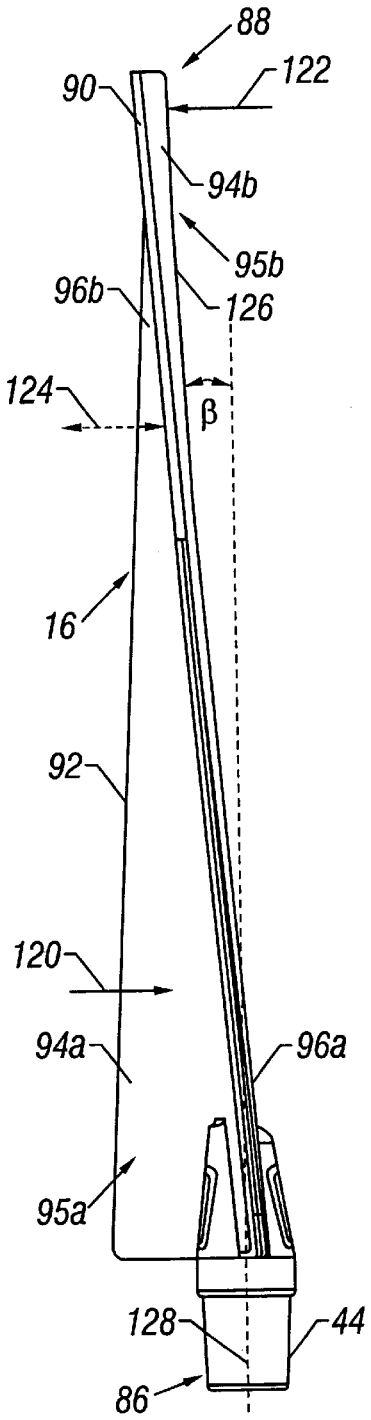
FIG. 12 is a schematic side view of another embodiment of the fan blade.

FIG. 12 is a schematic side view of an exemplary fan blade. Similar elements shown in FIGS. 1–11 are similarly numbered in FIG. 12. The fan blade 16 includes the root end 86 and the tip end 88, where the tip end 88 is disposed outwardly from the root end 86. The blade portion 44 is disposed in the region of the root end 86 for attachment to the hub (not shown). The blade 16 includes the leading edge 90 and the trailing edge 92. In one embodiment, the leading edge 90 and the trailing edge 92 are relatively straight; however, the edges can be curved or otherwise shaped.

The blade 16 can form an angle $\beta$ with respect to the centerline of the blade portion 44. The angle ú represents the angle between a projected surface 126 on the blade viewed from the side on the blade and a centerline 128 through the blade portion 44. In contrast to prior blades, the angle ú of the blade 16 in a stationary state can be designed to compensate for a blade deflection during rotation caused by forces on the blade during rotation. For example, the blade 16 can flex in a loaded condition from an angled orientation at angle ú to a substantially straight position that is substantially parallel with the centerline 128 of the blade portion 44. Such flexing can occur as a result of a force 120 on the blade 16 from the high pressure surface 94 toward the low pressure surface 96 during rotation. Such compensation is in contrast to prior efforts for molded blades that sought to counter the flexing by increasing the stiffness and cross sectional area. The flexing can be measured or calculated to be considered when placing the blade 16 in a housing or other structure (not shown) to optimize airflow and energy input requirements as desired.

Figure 13:
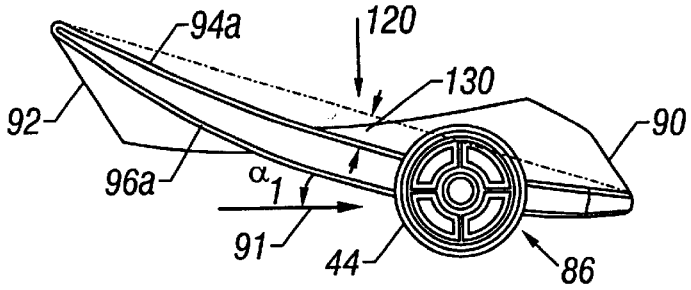
FIG. 13 is an end view of the fan blade shown in FIG. 12 from a root end.

FIG. 13 is an end view of the fan blade shown in FIG. 12 from a root end position. Similar elements shown in FIG. 12 are similarly labeled in FIG. 13. The leading edge 90 is disposed on the right side of the blade 16 and is generally rotated into the air or other media through which the blade travels. The trailing edge 92 is disposed opposite the leading edge 90 and is the last edge of the blade as the blade is rotated in the media. The high pressure surface 94 is shown in this embodiment on a top surface of the blade near the root end 86 and the low pressure surface 96 is shown on the bottom surface of the blade 16. The pitch angle $\alpha$ can be measured from a line representing the direction of rotation 91 to the line 93 being a chord between the leading edge 90 and trailing edge 92. As the blade rotates, a force 120 is created on the blade 16 in a direction away from the high pressure surface 94 and toward the low pressure surface 96, i.e., downward in the orientation shown in FIG. 13.

Further, the fan blade 16 is generally curved across the cross section of the blade. The amount of curve at the root end 86 can be represented by a first blade curvature distance 130 that is the perpendicular distance from a line between the leading edge 90 and the trailing edge 92 to a given point on the blade surface.

Figure 14:
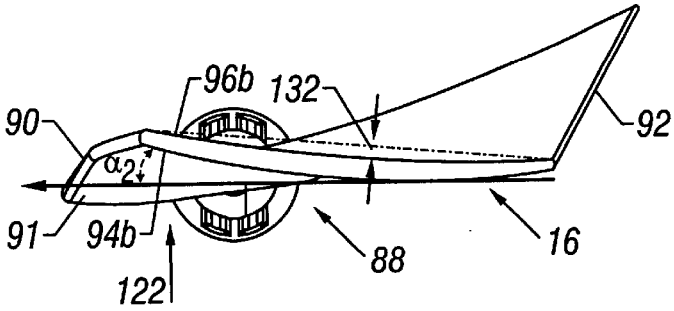
FIG. 14 is an end view of the fan blade shown in FIG. 12 from a tip end.

FIG. 14 is an end view of the fan blade shown in FIG. 12 from a tip end. Similar elements shown in FIGS. 12–13 are similarly labeled in FIG. 14. The leading edge 90 is shown on the left side of FIG. 14 and the trailing edge 92 is shown on the right side of FIG. 14, opposite from the leading edge. The high pressure surface 94 is shown as an upper surface of the blade 16 and the low pressure surface 96 is shown as a lower surface of the blade 16. The blade 16 is disposed at the pitch angle $\alpha$ at the tip end 88 that generally is smaller in value than a corresponding pitch angle $\alpha$ at the root end 86. Thus, more airflow can be generated and more load is created at the root end compared to the tip end. However, the pitch angle at the tip end can be the same or greater that the pitch angle at the root end, as may be desired.

Further, the fan blade 16 can be curved across a cross section of the blade at the tip end 88, similar to the blade curvature 130 at the root end 86, shown in FIG. 13. The amount of curve at the tip end 88 can be represented by a second blade curvature distance 132 which is the perpendicular distance from a line between the leading edge 90 and the trailing edge 92 to a given point on the blade surface. The second blade curvature distance 132 can be the same or different from the first blade curvature distance 130, shown in FIG. 13.

In some embodiments, the blade direction of rotation 91 may be reversed such that the trailing edge 92 and leading edge 90 reverse positions. In such embodiments, the force 120 could be reversed so that the blade forces air or other media in the opposite direction.

Figure 15:
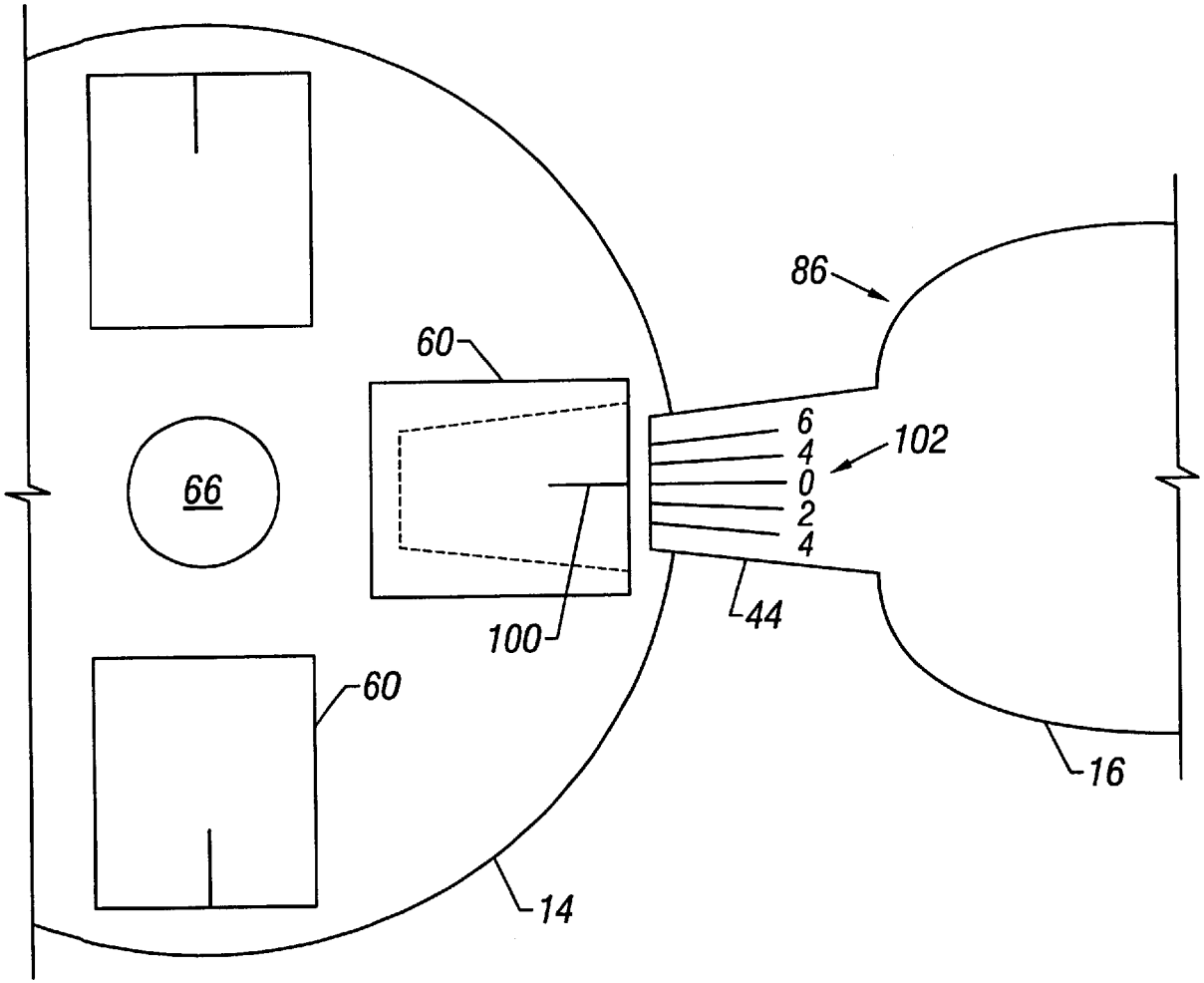
FIG. 15 is a schematic front view of a fan blade and fan blade receiver with alignment indicia.

FIG. 15 is a schematic front view of a fan blade and fan blade receiver with alignment indicia. Similar elements shown in FIGS. 5–7 are similarly labeled in FIG. 15. The hub 14 includes one or more blade receivers 60 formed thereon. In the embodiment shown in FIG. 15, four blade receivers could be formed, although it is to be understood that any number of blade receivers could be used depending on the particular design requirements of the fan. Generally, an opening 66 is disposed in the hub. The opening 66 is generally at a rotational center of the hub so that the hub can rotate about a shaft (not shown) disposed through the opening 66 or mounted to a shaft, such as on a motor. The blade 16 includes the blade portion 44 at the root end 86 of the blade. The blade portion 44 is used to couple the blade 16 to the hub 14. In one embodiment, the blade portion 44 may be inserted into an inner cavity of the blade receiver 60.

As discussed herein, the blade 16 can be adjusted to a variety of pitch angles. Generally, it is important that at least opposing blades across the diameter of the hub and customarily all the blades be adjusted to a consistent pitch angle. The adjustment can be made by turning the blade to a variety of angles with respect to the hub.

In one embodiment, one or more indicia 100 may be made on the blade receiver 60 to assist in obtaining a consistent pitch angle. Similarly, one or more indicia 102 may be made on the blade 16. One or both indicia 100, 102 can include a plurality of marks with numeric indicators as reference points. The indicia 102 on the blade 16 provides a reference point to align with the indicia 100 on the blade receiver 60 to adjust the pitch angle to a particular mark consistently for each blade around the hub. Alternatively, the indicia could be made on other surfaces as may be appropriate to assist in relative alignment.

Figure 16:
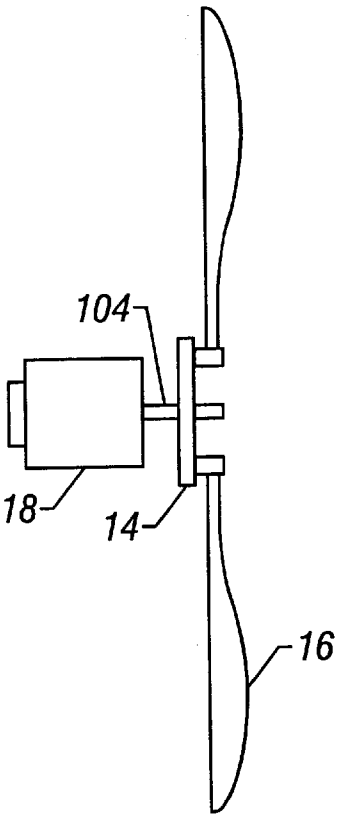
FIG. 16 is a schematic side view of a direct drive fan assembly.

FIG. 16 is a schematic side view of a direct drive fan assembly. The fan 1 includes a hub 14 that can be coupled to one or more fan blades 16. A motor 18 includes a shaft 104. The hub 14 can be directly coupled to the shaft 104 so that the coupling is a direct drive arrangement. The hub rotates as the shaft 104 rotates. If such an embodiment is used, bracing that is used to support the motor could be adjusted to accommodate mounting the motor in line with the rotational center of the housing 2 and the motor shaft 104 could replace the shaft 42, shown in FIG. 2.

Figure 17:
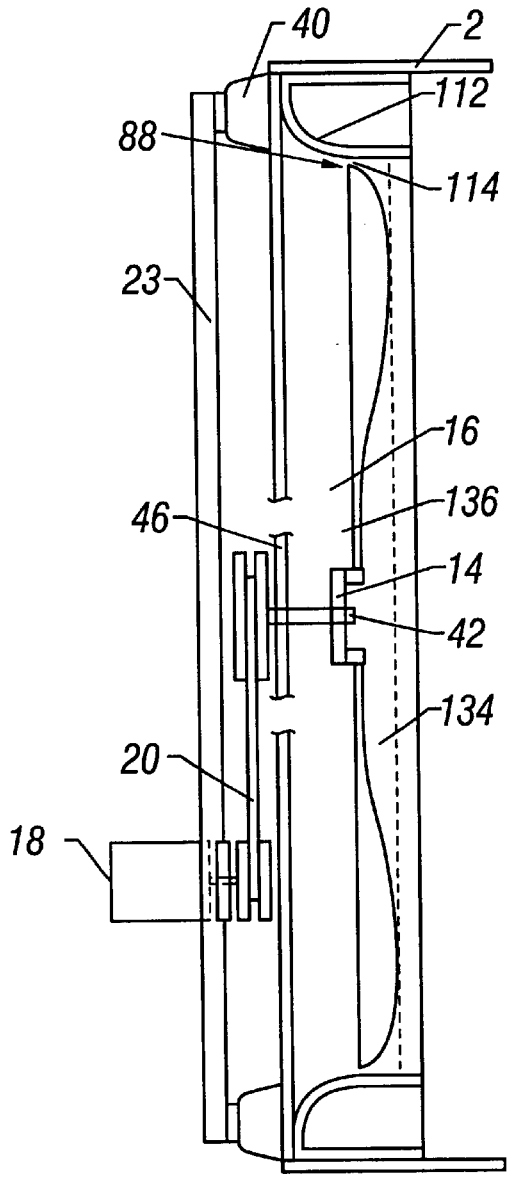
FIG. 17 is a schematic cross sectional view of another embodiment of a fan having a venturi and a plurality of fan blades mounted therein.

FIG. 17 is a schematic cross sectional view of another embodiment of a fan 1 having a venturi and a plurality of fan blades mounted therein. As an example, various embodiments of the fan, such as the embodiment shown in FIG. 17, can be used for a variety of ventilation applications, including agricultural fans. A venturi 110 can be formed circumferentially around the tip end 88 of the fan blade 16. The venturi 110 can be formed as an integral part with the housing 2 or alternatively as part of the frame member 11. Further, the venturi 110 can be formed as a separate member and affixed to the frame member 11 or housing 2. The venturi 110 can assist in reducing turbulence at the tip end 88 of the fan blade 16 and in providing more laminar or uniform flow from the fan blade.

The venturi has a depth 111 that is measured from front to back of the venturi 110. In one embodiment, the depth is at least at least as deep as a blade disc 134 formed by the fan blades 16. The blade disc 134 is an imaginary volume having a depth formed by the most forward and rearward points of the blades 16 as the blades are rotated and a diameter formed by the rotation of the blades at the tip end 88. In one embodiment, the blade disc 134 should be enclosed by a venturi volume 136 created by the depth 111 and diameter of the venturi 110.

A certain amount of clearance 114 is generally formed between the outer edge of the fan blade 16 at the tip end 88 and the inner edge of the venturi 110. In general, a smaller clearance yields greater efficiency of the fan. However, the clearance is practically limited by the accuracy and amount of non-concentricity, also known as "run-out," formed by the venturi and the fan blades. Also, a smaller clearance can help reduce turbulence at the tip end 88. Reduction in tip turbulence can help develop laminar flow through the venturi and out an exit of the fan. If the blade flexes, as described in reference to FIG. 12, a suitable clearance can be allowed for the blade in a rotating and non-rotating position.

A motor 18 is coupled to a motor support 24 described in more detail in FIGS. 1–2. A drive member 20 is coupled between the motor 18 and the hub 14. The drive member can include a drive belt, chain, gear, and other elements that transfer power from one member to another. The hub 14 is rotatably disposed about a shaft 42. The shaft 42 can be coupled to a brace 23.

Figure 18:
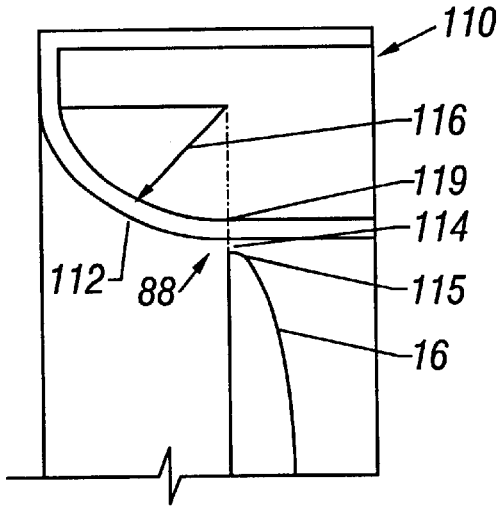
FIG. 18 is a schematic cross sectional view of a venturi shown in FIG. 17.

FIG. 18 is a schematic cross section view of the venturi shown in FIG. 17. Similar elements shown in FIG. 17 are labeled in FIG. 18. The venturi 110 includes a lip 112. The lip 112 can have a curved shaped as defined by a radius 116. Alternatively, the lip 112 can be formed into a variety of geometric shapes. In one embodiment, the radius 116 forms a smooth transition between a larger diameter and a smaller diameter of the venturi lip 112, the smaller diameter being adjacent a tip end 88 of the blade 16. A clearance 114 is formed between the inner surface of the lip 112 and the outer tip 115 of the blade 16. Further, the radius 1 16 can define an arc that ends at a radius endpoint 119 on the lip 112. In one embodiment, the outer tip 115 can be aligned with an imaginary line from the center of the radius 116 to the radius endpoint 119. Such an alignment may also increase efficiency and/or laminar flow. Such alignment can occur when the blade 16 is flexed into a position under loaded conditions during rotation, as described in reference to FIG. 12.

One method of forming one or more parts of the fan including the hub, fan blades, and any outer housing, can be by molding the various portions and assembling thereto. Such molding may be formed, for example, by injection molding, including pressure injection molding, resin injection molding, rotational molding, resin transfer molding, and other types of molding.

These molding techniques allow the formation of a variety of unique shapes, including the reversing pitch angle fan blades 16 described in reference to FIGS. 12–14 and the curved surface for the venturi 110, described in FIGS. 17–18.

As an example, a resin transfer molding (RTM) process can be used. The RTM process is a derivative of injection molding except that fluid resin is generally injected into a fibrous preform instead of an empty cavity mold. The process involves two basic procedures: fabricating a fiber preform in the general shape of the finished article and impregnating the preform with a thermosetting resin while the preform is disposed in a mold. The resulting fiber reinforced composite article can be strong and relatively light.

Generally, a pre-shaped fiber reinforcement, the preform, is positioned within a molding tool cavity and the molding tool is then closed. A feed line connects the closed molding tool cavity with a supply of liquid resin and the resin is pumped or "transferred" into the tool cavity where the resin impregnates and envelops the fiber reinforcement and subsequently cures. The cured or semi-cured fiber reinforced plastic product then is removed from the molding tool cavity.

Tooling used with RTM may include a metallic shell to facilitate heat transfer. Although the mixing pressure is relatively high, the overall pressure of the resin in the molding tool generally is only about 10 PSI to about 35 PSI, depending on the tool complexity, and content of reinforcement fibers. The resin flows into the molding tool cavity and "wets out" the preform reinforcement as the curing reaction occurs. Flow distances may be limited and for longer flow distances multiple inlet ports may be required due to rapid resin cure.

One exemplary method of molding the various components includes blending together a molding material which includes a fiber reinforced thermoplastic polymer and may include fibers of graphite carbon or glass, heating the molding material to a viscous molten state, injecting the molding material under high pressure into a mold, and cooling the molding material to form a component.

For example, some materials that can be used are thermoplastic polymers such as polypropylene, polyetherimide, polyphenylene sulfide, polyetheretherketone, polyphthalarnide, polyamide, polysulfone, polyarylsulfone, polyethersulfone, polybutylene terephtalate, polyethylene terephthalate, polyamide-imide, urethanes, and other polymeric compounds.

With respect to the fibers employed in the blended material, generally long fibers can be used to advantage, such as those fibers having a length of at least about one-half inch. Long fibers can provide reinforcement and about twice the pull-out strength of short or chopped fibers. Fibers can include about 15% to about 45% of the entire material mix, with one range being close to about 30%. Fibers can include glass, nylon, graphite Kevlar®, graphite carbon, agricultural fibers such as cotton, and other available fibers.

Once the molding material has been blended, the second step in the inventive process is to heat the material to a viscous molten state. The molten molding material is injected under high pressure into a mold. Once the injection step is completed the blade apparatus is essentially finished. The mold is cooled in a known fashion, and the finished blade apparatus is removed therefrom.

The injection process may include two halves that define a mold cavity for a one-piece injection molded component. Molten plastic is introduced into ports (runners) to fill the cavity. After the resulting plastic component cools, the mold is opened along a parting line. The molded component can be removed by an ejector system, usually by means of a moving ring that dislodges the band, and a set of pins that dislodge the molded component.

In one embodiment, the RTM process includes molding one or more of the various components discussed herein from a blended material that includes a thermoplastic polymer, such as glass-filled polypropylene or glass-filled nylon, most preferably 30% glass by weight, reinforced with long fibers, and a spar to which the blade portion is attached. For example, the frame member, the housing, and the venturi can be formed is such manner. This weight percentage may be varied considerably. The hub, the fan blades, and the drive surfaces, such as a pulley, and other components can be molded with the same or similar process.

Comparative tests of an exemplary high performance prior art metal fan, a low performance prior art plastic fan, and a high performance non-metallic fan as described herein are shown in the examples below. Generally, fan performance is rated as an airflow unit per energy input unit at a certain pressure. For example, performance units can be expressed as cubic feet per minute per watt of power (CFM/watt) measured at some static pressure in inches of water. The watts of power are generally measured at the input to an electrical motor if an electrical motor is used. Alternatively, the effective watts can be calculated by formulae known to those with ordinary skill in the art for other types of motors such as fuel driven motors, hydraulic or pneumatic motors, and other drive mechanisms. Test data for the CFM can be determined at a static pressure of about 0.00 inches of water with no backpressure. Because some applications can create a backpressure on the fan blade, an alternative performance measurement can be made at some pressure level.

Comparison 1

One exemplary high performance metal fan is made by American Coolair Model Number NBF/CBL36. The model has been tested by the Bioenvironmental and Structural Systems Laboratory in the Department of Agricultural Engineering at the University of Illinois at Urbana-Champaign. The results of this fan and others are found in a standard test data manual entitled "Agricultural Ventilation Fans--Performance and Efficiencies," produced by the Laboratory. The fan is a 36-inch diameter, belt driven fan. The blades, hub, and housing are metallic. A ½ horsepower motor is generally used and, specifically, a General Electric motor model number 5KHC39ZN9220X was used for the model tested. An aluminum shutter and guard accompanied the tested model. The blades were rotated at about 450 RPMs to about 460 RPMs. The fan produced an efficiency rating of 21.9 CFM/watt at a static pressure of about 0.00 inches of water. The fan also produced an efficiency rating of 14.3 CFM/watt at a static pressure of about 0.15 inches of water.

Research showed that commercial, molded fan assemblies, including molded hubs and molded blades, are unavailable for high performance fans in at least the 24-inch sizes and above. Thus, there was no available test data for such assemblies.

Example 1 of an Embodiment of the Fan

A fan produced with at least some of the features described herein was tested. The fan was a 36-inch fan and included substantially a non-metallic hub, four non-metallic blades as described herein, and a non-metallic housing. The fan used a ½ horsepower motor by Emerson and produced an efficiency at least 20 CFM/watt at a static pressure of about 0.00 inches of water, and generally above about 25 CFM/watt. Further, the fan produced an efficiency at least about 15 CFM/watt at a static pressure of about 0.15 inches of water. In some tests, the efficiencies were higher than the comparison example of the metallic fan above. In at least one test, the efficiency was over 16 CFM/watt and approached at a static pressure of about 0.15 inches of water.

While the foregoing is directed to various embodiments of the present invention, other and further embodiments may be devised without departing from the basic scope thereof. For example, the various methods and embodiments of the invention can be included in combination with each other to produce other variations of the disclosed methods and embodiments. Also, the directions such as "top," "bottom," "left," "right," "upper," "lower," and other directions and orientations are described herein for clarity in reference to the figures and are not to be limiting of the actual device or use of the device as the device may be used in a number of directions and orientations. Further, the headings herein are for the convenience of the reader and are not intended to limit the scope of the invention.

What is claimed is:

1. A cooler, comprising:

a) a cooler housing having an exterior, an interior, and front and rear openings;

b) at least one evaporative cooling pad coupled to the housing;

c) a molded hub having a plurality of fan blade receivers; and d) a plurality of molded fan blades removably attachable to the fan blade receivers, the fan blades each having a blade portion attachable to the fan blade receivers on the hub.

2. The cooler of claim 1, further comprising a first alignment indicia disposed on the fan blade receivers and a second alignment indicia disposed on the fan blades.

3. The cooler of claim 1, wherein the fan blades comprise an airfoil cross section having a high pressure portion on one side and a low pressure portion of an opposite side.

4. The cooler of claim 1, wherein the fan blades further comprise a longitudinal twist from the blade portion toward a tip end of the fan blades.

5. The cooler of claim 1, wherein the cooler produces an airflow of at least about 15 cubic feet per minute (CFM) per watt at a static pressure of about 0.15 inches of water.

6. The cooler of claim 1, further comprising a venturi wherein the fan blades are adapted to at least partially rotate within a cross sectional volume formed by the venturi.

7. The fan of claim 1, wherein the hub and fan blades are molded by a resin transfer molding (RTM) method.

8. The fan of claim 7, wherein the molded hub comprises fiber reinforced polymeric material.

9. The fan of claim 7, wherein the fan blades comprise fiber reinforced polymeric material.

10. The fan of claim 1, further comprising one or more drive surfaces integrally formed on the molded hub.

11. The fan of claim 2, wherein the fan blades are rotationally indexable relative to the hub using the alignment indicia.

12. A cooler, comprising:

a) an evaporative cooler housing having an exterior, an interior, and front and rear openings;

b) a molded hub having a plurality of fan blade receivers; and c) a plurality of molded fan blades removably attachable to the fan blade receivers, the fan blades each having a blade portion attachable to the fan blade receivers on the hub.

13. The cooler of claim 12, further comprising a first alignment indicia disposed on the fan blade receivers and a second alignment indicia disposed on the fan blades.

14. The cooler of claim 12, wherein the fan blades comprise an airfoil cross section having a high pressure portion on one side and a low pressure portion of an opposite side.

15. The cooler of claim 12, wherein the fan blades further comprise a longitudinal twist from the blade portion toward a tip end of the fan blades.

16. The cooler of claim 12, wherein the cooler produces an airflow of at least about 15 cubic feet per minute (CFM) per watt at a static pressure of about 0.15 inches of water.

17. The cooler of claim 12, further comprising a venturi wherein the fan blades are adapted to at least partially rotate within a cross sectional volume formed by the venturi.

18. The fan of claim 12, wherein the hub and fan blades are molded by a resin transfer molding (RTM) method.

* * * * *